US005099242A

United States Patent [19]

Jaggard et al.

[11] Patent Number: 5,099,242

[45] Date of Patent: Mar. 24, 1992

[54] NOVEL SHIELDING, REFLECTION AND SCATTERING CONTROL USING CHIRAL MATERIALS

[75] Inventors: Dwight L. Jaggard, Newtown Square; Nader Engheta, King of Prussia, both of Pa.

[73] Assignee: The Trustees of the University of Pennsylvania, Philadelphia, Pa.

[21] Appl. No.: 461,042

[22] Filed: Jan. 4, 1990

[51] Int. Cl.[5] ..... H01Q 17/00

[52] U.S. Cl. ..... 342/1; 342/4

[58] Field of Search ..... 342/1,4

[56] References Cited

U.S. PATENT DOCUMENTS

| | | | |
|---|---|---|---|
| 2,293,839 | 8/1992 | Linder | 342/1 |
| 4,012,738 | 3/1977 | Wright | 342/1 |
| 4,452,727 | 6/1984 | Frommer et al. | 252/518 |
| 4,456,548 | 6/1984 | Lewis et al. | 252/500 |
| 4,574,282 | 3/1986 | Crossland et al. | 350/333 X |
| 4,616,067 | 10/1986 | Lee et al. | 525/192 |
| 4,678,616 | 7/1987 | Tzeng | 428/551 |
| 4,725,490 | 2/1988 | Goldberg | 342/1 |
| 4,948,922 | 8/1990 | Varadan et al. | 174/35 GC |

OTHER PUBLICATIONS

J. A. Kong, Theory of Electromagnetic Waves, 1975, pp. 2–79.

E. J. Post, Formal Structure of Electromagnetics, 1962, pp. 127–176.

D. L. Jaggard et al., Applied Physics, vol. 18, No. 211, 1979, "On Electromagnetic Waves in Chiral Media".

S. Bassiri et al., Alta Frequenza, vol. 2, No. 83, 1986, "Dyadic Green's Function and Dipole Radiation in Chiral Media".

N. Engheta et al., IEEE Trans. on Ant. & Propag., vol. 37, No. 4, Apr. 1989, pp. 512–515, "One and Two-Dimensional Dyadic Green's Function in Chiral Media".

S. Bassiri et al., J. Opt. Soc. Am., vol. 5, No. 9, 1988, pp. 1450–1459, "Electromagnetic Wave Propagation Through a Dielectric-Chiral Interface and Through a Chiral Slab".

R. B. Kaner et al., "Plastics That Conduct Electricity," Scientific American (Feb. 1988), pp. 106–111.

A. Lakhtakia et al., "Scattering and Absorption Characteristics of Lossy Dielectric, Chiral, Non-Spherical Objects," Applied Optics, vol. 24, No. 23 (Dec. 1, 1985), pp. 4146–4153.

A. Lakhtakia et al., "A Parametric Study of Micro Reflection Characteristics of a Planar Achiral-Chiral Interface," IEEE Transactions on Electromagnetic Compatibility, vol. EMC-28, No. 2 (May 1986), pp. 90–95.

Varadan et al., "On the Possibility of Designing Antireflection Coatings Using Chiral Composites," Journal of Wave Material Interaction, vol. 2, No. 1 (Jan. 1987), pp. 71–81.

Jaggard et al., "Chirosorb TM As An Invisible Medium", Electronics Letters, Feb. 1989, vol. 25, No. 3, pp. 173–174.

Engheta et al., "Modes in Chirowaveguides", Optics Letters, vol. 14, No. 11, Jun. 1989, pp. 593–595.

*Primary Examiner*—Gilberto Barron, Jr.

*Attorney, Agent, or Firm*—Synnestvedt & Lechner

[57] ABSTRACT

Electromagnetic and optical shields, controllers, and reflectors comprising chiral materials. Electromagnetic and optical controllers and layers provided in accordance with this invention comprise chiral materials wherein reflection, scattering, absorption and shielding properties can be tailored over specified frequency regime. Layered structures have a variety of potential applications in radar cross section management, radar absorbers for low observables and other applications, radomes, antennae, and radio wave, microwave and millimeter wave chambers. Likewise, these structures have many applications to electronic devices, integrated optics, and optical components and systems, as well as in their radio wave, microwave, and millimeter wave counterparts.

13 Claims, 5 Drawing Sheets

NOVEL SHIELDING, REFLECTION AND SCATTERING CONTROL USING CHIRAL MATERIALS

FIELD OF INVENTION

This invention generally relates to electromagnetic scatterers. More specifically, this invention relates to coated electromagnetic scatterers comprising chiral materials.

BACKGROUND OF THE INVENTION

It has been shown that, for time-harmonic electromagnetic fields with exp $(-i\omega t)$ excitation, a homogeneous, low loss, isotropic chiral (optically active) medium can be described electromagnetically by the following constitutive relations:

$$D=\epsilon E+i\xi_c B \quad (1)$$

$$H=i\xi_c E+(1/\mu)B \quad (2)$$

where E, B, D and H are electromagnetic field vectors and $\epsilon$, $\mu$, $\xi_c$ represent the dielectric constant, permeability and chirality admittance of the chiral medium, respectively. A "chiral medium" comprises chiral objects of the same handedness, randomly oriented and uniformly distributed. The chirality admittance $\xi_c$ is a measure of handedness of the medium. A chiral object is a three-dimensional body that cannot be brought into congruence with its mirror image by translation and rotation. Therefore, all chiral objects can be classified in terms of their "handedness." The term "handedness," as known by those with skill in the art, refers to whether a chiral object is "right-handed" or "left-handed." That is, if a chiral object is right-handed (left-handed), its mirror image is left-handed (right-handed). Therefore, the mirror image of a chiral object is its enantiomorph.

Chiral media exhibit electromagnetic chirality which embraces optical activity and circular dichroism. Optical activity refers to the rotation of the plane of polarization of optical waves by a medium while circular dichroism indicates a change in the polarization ellipticity of optical waves by a medium. There exists a variety of materials that exhibit optical activity. For example, for 0.63-$\mu$m wavelength, $TeO_2$ exhibits optical activity with a chirality admittance magnitude of $3.83\times10^{-7}$ mho. This results in a rotation of the plane of polarization of 87° per mm. These phenomena, known since the mid nineteenth century, are due to the presence of the two unequal characteristic wavenumbers corresponding to two circularly polarized eigenmodes with opposite handedness. The fundamentals of electromagnetic chirality have been treated in books by Kong [J. A. Kong, *Theory of Electromagnetic Waves*, 1975] and Post [E. J. Post, *Formal Structure of Electromagnetics*, 1962]. More recent work includes the macroscopic treatment of electromagnetic waves with chiral structures [D. L. Jaggard et al. *Applied Physics*, 18, 211, 1979], the analysis of dyadic Green's functions and dipole radiation in chiral media [S. Bassiri et al. *Alta Frequenza*, 2, 83, 1986; N. Engheta et al. *IEEE Trans. on Ant. & Propag.*, 37, 4, 1989], and the reflection and refraction of waves at a dielectric-chiral interface [S. Bassiri et al. *J. Opt. Soc. Am.* A5, 1450, 1988].

SUMMARY OF THE INVENTION

The methods and structure provided in accordance with this invention achieve novel and unexpected results in electromagnetic scattering and surface effects. The chiral structures herein claimed and disclosed provide highly efficient electromagnetic absorbers and reflectors and solve a long felt need in the art which has heretofore been unfulfilled for electromagnetic media that substantially reduce undesired reflections and surface effects.

In accordance with the present invention, there are provided, coated electromagnetic scatterers comprising scattering means for scattering electromagnetic radiation and, at least one chiral layer coating the scattering means for altering scattering and surface wave effects from the scattering means.

Methods of constructing coated electromagnetic scatterers which reduce scattering of electromagnetic radiation and surface wave effects, are also provided in accordance with the present invention. The methods generally comprise the steps of coating an electromagnetic scatterer with a plurality of chiral layers having specified thicknesses which alter scattering and surface wave effects, and coating the electromagnetic scatterer with a plurality of nonchiral layers having specified thicknesses which alter scattering and surface wave effects, wherein the chiral and nonchiral layers are adapted to provide modification of impedance matching and absorption for electromagnetic radiation.

BRIEF DESCRIPTION OF THE DRAWINGS

FIGS. 3*a* and 3*b* show two preferred embodiments of planar chiroshields wherein FIG. 3*a* is the quarter-wave spacer case where an electrically thin lossy chiral sheet of thickness $\Delta$ covers a nonchiral or chiral spacer of thickness d which together are on top of a shielded region, and FIG. 3*b* is a null spacer case where an electrically thin lossy chiral sheet of thickness $\Delta$ covers a shielded region and no spacer exists (d=0).

DETAILED DESCRIPTION OF PREFERRED EMBODIMENTS

Figure 1:
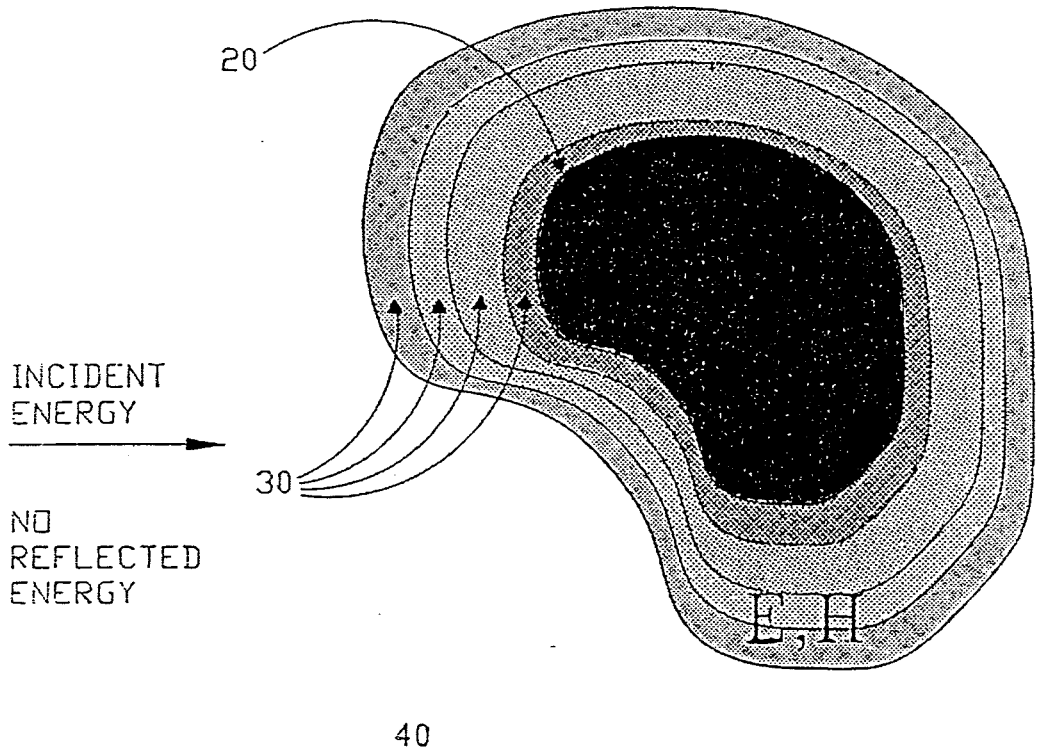
FIG. 1 shows a body of arbitrary shape covered by a layered chiral structure surrounded by an exterior region.

The inventors of the subject matter disclosed and claimed herein have achieved novel results in the theoretical investigation of the electromagnetic and optical shielding structures and other scattering layers comprising chiral materials. The terms "chirolayer" and "layered chiral structure" are used interchangeably throughout the present disclosure to denote such structures provided in accordance with the present invention. Two examples of chirolayer or layered chiral structure are denoted "chiroshield" and "chiroreflector." As known by those with skill in the art, a "layered chiral structure" is a composite layered structure wherein one or more layers are made of chiral materials. Such layered chiral structures intended primarily to shield a region from the electromagnetic and/or optical energy is called "chiroshield." Likewise, such layered chiral structures intended primarily to enhance the scattering of electromagnetic and/or optical energy from a region is called "chiroreflector." Layered chiral structures have a variety of potential applications in radar cross section management, radar absorbers for low observables and other applications, radomes, antennae, and radio wave, microwave and millimeter wave chambers. Likewise, layered chiral structures have many applications to electronic devices, integrated optics, and optical components and systems, as well as in their radio wave, microwave, and millimeter wave counterparts.

Consider the time-harmonic Maxwell equations with $e^{-i\omega t}$ excitation ($\omega$ is the radian frequency and t is time) and the electric current density and charge density J and $\rho$ $$\nabla\times E=i\omega B \tag{3}$$

$$\nabla\times H=J-i\omega D \tag{4}$$

$$\nabla\cdot B=0 \tag{5}$$

$$\nabla\cdot D=\rho. \tag{6}$$

From the constitutive relations (1) and (2) and the source-free Maxwell equations (3)–(6), the following chiral Helmholtz equation is obtained $$\nabla\times\nabla\times C-2\omega\mu\xi_c\nabla\times C-k^2C=0 \tag{7}$$

where C is any one of electromagnetic field vectors E, H, B and D, with $k=\omega\sqrt{\mu\epsilon}$ where $\omega$ is the radian frequency of the time harmonic fields. There exist two eigenmodes of propagation, a right-circularly and a left-circularly polarized (RCP and LCP), respectively, plane wave with wavenumbers $$k\pm = k[\sqrt{1+\eta^2\xi_c^2} \pm \eta\,\xi_c] \tag{8}$$

which exhibit the wavenumber splitting characteristic of chiral material. Here $k(=\omega\sqrt{\mu\epsilon})$ and $\eta(=\sqrt{\mu/\epsilon})$. Optical activity occurs when $k_\pm$ are both real and have different values. When $k_\pm$ are complex and nonidentical, both optical activity and circular dichroism are present in this material.

Relating solutions of equation (7) by the Maxwell curl equations (3)–(4) and the constitutive relations (1)–(2) yields the ratio $$(k_\pm/k_\pm)\times E=\eta_c H \tag{9}$$

where $k_\pm$ is the wave vector associated with the wavenumber $k_\pm$ and $$\eta_c = \eta/\sqrt{1+\eta^2\xi_c^2} \tag{10}$$

is the chiral impedance. A similar relation links the displacement field D and the magnetic flux density B.

Referring now to the drawings wherein like reference numbers refer to like elements, FIG. 1 shows a region 20 of arbitrary shape covered by a layered chiral structure 30 surrounded by the exterior region 40 which is the environment of the coated electromagnetic scatterer comprised of scatterer 20 and chiral layers 30. In preferred embodiments scattering region 20 is a conductive medium or any scattering means which will scatter electromagnetic radiation. In still further preferred embodiments, the chiral layers 30, which generally comprise chiral materials, are electromagnetically interfaced with the conductive scatterer 20.

As provided in accordance with the present invention, the electric and magnetic field vectors E and H, in the layered chiral region 30, satisfy the following chiral Helmholtz equation $$\nabla\times\nabla\times\begin{pmatrix}E\\H\end{pmatrix}-2\omega\mu\xi_c\nabla\times\begin{pmatrix}E\\H\end{pmatrix}-k^2\begin{pmatrix}E\\H\end{pmatrix}=0 \tag{11}$$

and the boundary conditions $$n\times(E_i-E_{i+1})=0,\quad (i=1,2,3,\ldots,n+1) \tag{12}$$

$$n\times(H_i-H_{i+1})=0,\quad (i=1,2,3,\ldots,n+1) \tag{13}$$

for an n-layer structure.

As known by those with skill in the art, one way of shielding electrical conductors from electromagnetic energy is through the use of a Salisbury shield in which an electrically thin lossy dielectric material is placed a quater wavelength away from the surface to absorb maximum electric field or an electrically thin lossy magnetic material is placed on the surface to absorb maximum magnetic field. To date, the problem facing skilled artisans has been to fabricate materials with desired characteristics to obtain the correct impedance match necessary for near-perfect and subsequent absorption which gives rise to near-zero reflection from covered conductors. The chiral structures provided in accordance with the present invention provide those materials which attain near-zero reflections from covered conductors.

Figure 2:
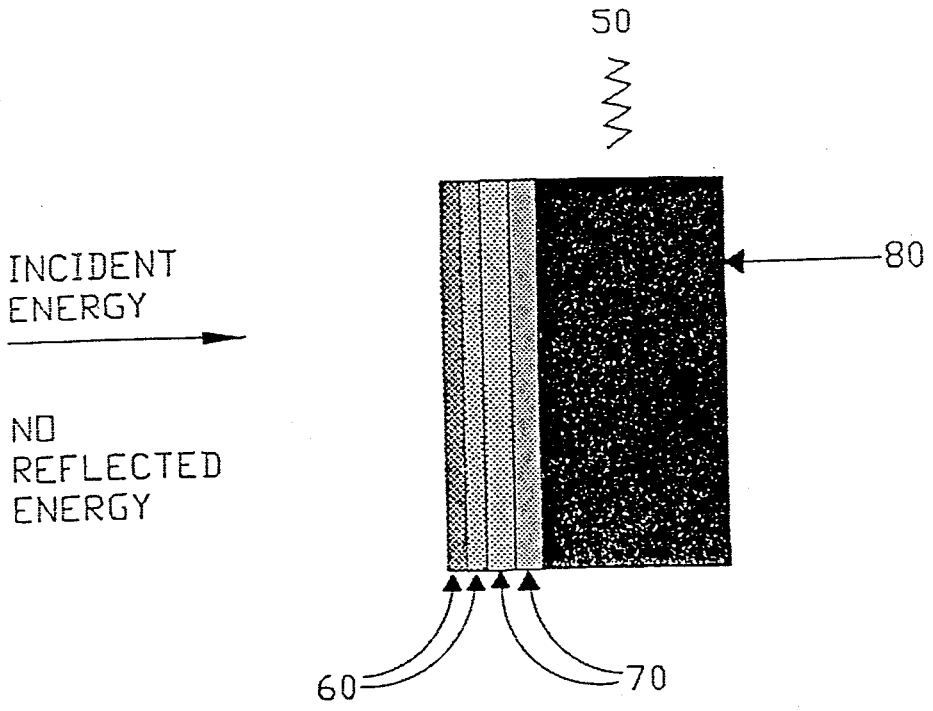
FIG. 2 shows a preferred embodiments of a chiroshield for preventing reflection of electromagnetic energy for waves at normal incidence comprising one or more chiral layers on top of one or more nonchiral coatings, and a shielded region.

Referring to FIG. 2, a chiroshield 50 using a planar structure comprising one or more chiral layers 60 on top of one or more nonchiral coatings 70 or a suitable combination thereof, and a shielded region 80, in preferred embodiments, is shown. The power reflection coefficient R, for the case of a single electrically thin lossy chiral sheet of thickness $\Delta$ and one nonchiral layer with thickness d, is the ratio of reflected power to incident power. It is given by $$R=\left|\frac{-\Gamma[1-\alpha_-]\cos(k_cd)-i[1-\beta_-]\sin(k_cd)}{+\Gamma[1+\alpha_+]\cos(k_cd)-i[1+\beta_+]\sin(k_cd)}\right|^2 \tag{14}$$

-continued where $$\Gamma = \frac{\eta_2}{\eta_1}$$

$$k_c = \frac{1}{2}[k_+ + k_-]$$

$$\alpha_\pm = \frac{i\omega\Delta\mu}{\eta_2} \pm i\omega\Delta\mu\xi_c$$

$$\beta_\pm = i\omega\Delta\epsilon\eta_2 + i\omega\Delta\mu\eta_2\xi_c^2 \pm i\omega\Delta\mu\xi_c$$

$d$ = width of spacer $\Delta$ = width of resistive sheet (assumed to be much less than a wavelength, and preferably less than a half-wavelength)

and $\epsilon$, $\mu$ and $\xi_c$ are the (possibly complex) permittivity, permeability and chiral admittance of the resistive sheet and $k_{35}$ and $k_-$ are the wavenumbers of the (possibly chiral) spacer. Here $\eta_2$ is the impedance (possibly chiral) of the spacer and $\eta_1$ is the impedance of the medium on the exterior of the structure (usually taken as that of free-space). However, it will be recognized that for the case of a multiplicity of nonchiral and chiral layers, $\Delta$ may take on an arbitrary value.

Figure 3A:
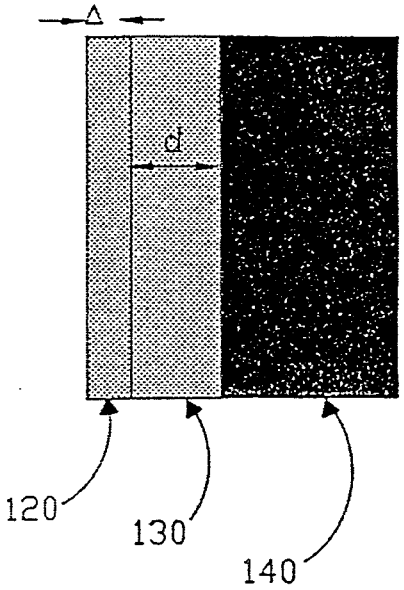
Figure 3B:
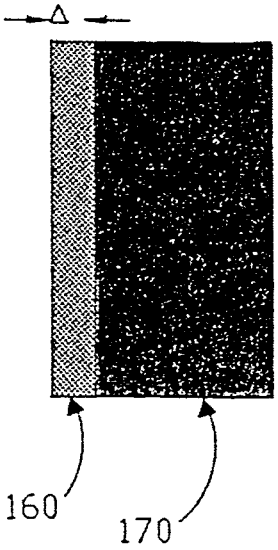

There are many possibilities for zero reflection (R=0) with chiroshield in the given expression (14). The first case is the quarter-wave spacer case shown in FIG. 3*a* where an electrically thin lossy chiral sheet of thickness $\Delta$ 120 covers a nonchiral or chiral spacer of thickness d 130 which together are on top of a shielded region 140. If $k_c d = \pi/4$, from relation (14) the zero reflection condition is given by $\beta_- = 1$. Although this condition is difficult to achieve in the nonchiral case ($\xi_c = 0$) due to material constraints, in the chiral case there are additional degrees of freedom which allow the condition $\beta_- = 1$ to hold. This achieves zero reflection at the frequency of the incoming electromagnetic wave and its harmonics. Several layers can be used to obtain a broader band response. If the condition that the lossy sheet thickness $\Delta$ is small compared to a wavelength does not hold, the same principle can be used with a similar analysis. The second case is the null spacer case shown in FIG. 3*b* where an electrically thin lossy chiral sheet of thickness $\Delta$ 160 covers a shielded region 170 and no spacer exists (d=0). If $k_c d = 0$, the zero reflection condition from relation (14) is given by $\alpha_- = 1$. Again, this condition is difficult to achieve in the nonchiral case since lossy magnetic material with a specified loss is difficult to obtain. However, in the chiral case, this condition can be achieved through use of the chirality admittance in conjunction with magnetic and dielectric materials. A further virtue of this method is that since there is no spacer, the shield is effective at all frequencies such the resistive sheet thickness $\Delta$ is small compared to a wavelength. If this thickness condition does not hold, the same principle can be used following additional analysis. The dielectric and magnetic materials herein discussed may be partially lossy in preferred embodiments. Similarly, the chiral layers herein discussed by also themselves be partially lossy depending upon the particular impedance matching results desired.

Figure 4A:
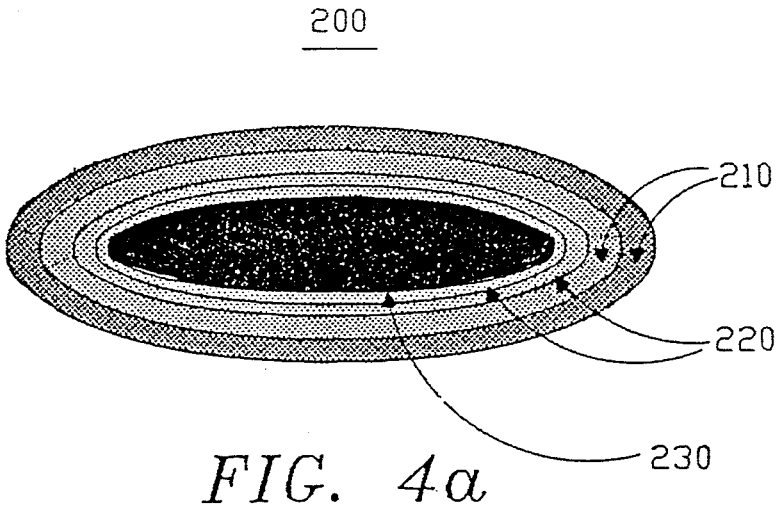
FIGS. 4*a*, 4*b* and 4*c* show (4*a*) a novel chiroshield for nonplanar structures comprising one or more chiral layers on top of one or more nonchiral coatings or a suitable combination thereof, and a shielded region; (4*b*) a preferred embodiment where an electrically thin lossy chiral sheet of thickness $\Delta$ covers a nonchiral or chiral spacer of thickness d which together are on top of a shielded region; and (4*c*) another preferred embodiment where an electrically thin lossy chiral sheet of thickness $\Delta$ covers a shielded region.
Figure 4B:
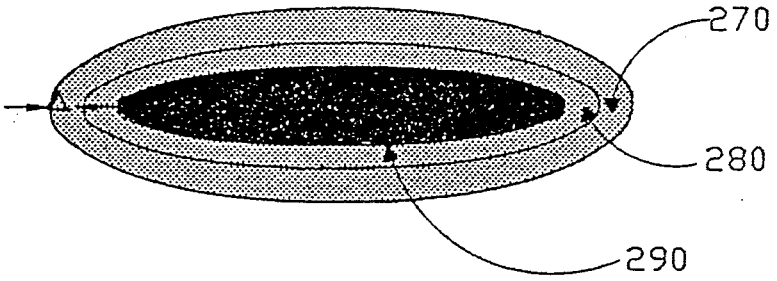

Referring to FIGS. 4*a*, a chiroshield 200 using a nonplanar structure comprising one or more chiral layers 210 on top of one or more nonchiral coatings 220 or a suitable combination thereof, and a shielded region 230, in preferred embodiments, is shown. In FIG. 4*b* an electrically thin lossy chiral sheet of thickness $\Delta$ 270 covers a nonchiral or chiral spacer of thickness d 280 which together are on top of a shielded region 290. Under appropriate conditions relating the thicknesses d and $\Delta$, the size and composition of the shielded region, and the wavelength of the incident field, the reflection or scattering in a given direction can be minimized. If this thickness condition does not hold, the same principle can be used following additional analysis.

Figure 4C:
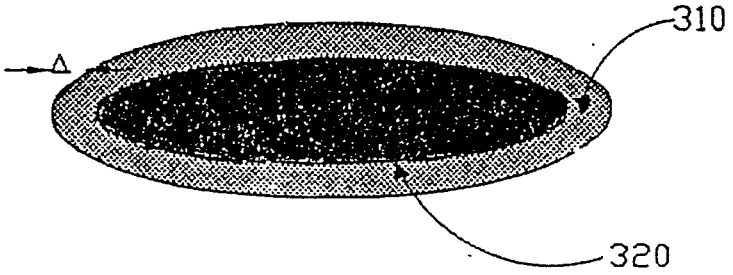

Likewise, referring to FIG. 4*c*, an electrically thin lossy chiral sheet of thickness $\Delta$ 310 covers a shielded region 320. Under appropriate conditions relating the thickness $\Delta$, the size and composition of the shielded region and the wavelength of the incident field, the reflection or scattering in a given direction can be minimized. As before, if this thickness condition does not hold, the same principle can be used following additional analysis.

Although the preferred embodiments shown here in FIGS. 2–4 are for simple shapes, either planar or ellipsoidal, other preferred embodiments hold for other shapes, either regular or irregular.

Figure 5:
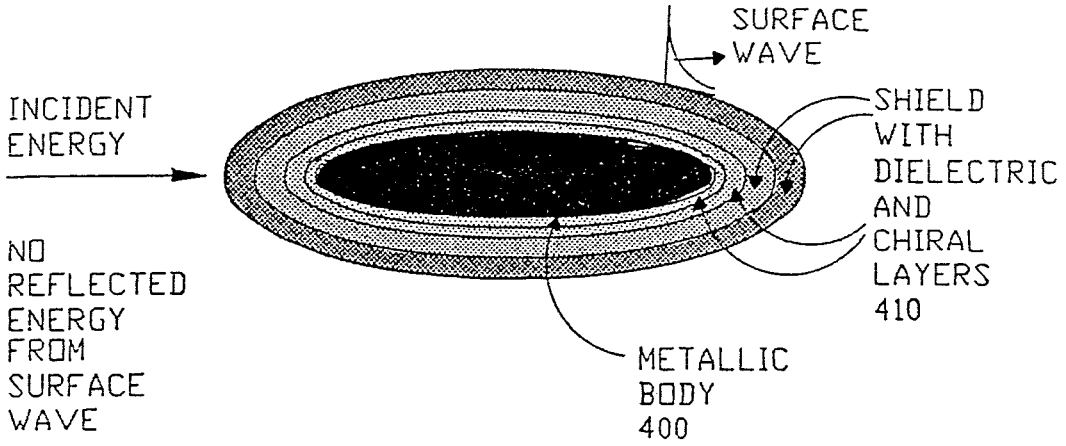
FIG. 5 shows a preferred embodiment of novel chiroshields for preventing reflection of electromagnetic energy for incident grazing waves wherein a metallic or highly conducting body is covered with a chiral shield comprising one or more chiral or nonchiral layers. The chiroshield absorbs the surface waves before they can reradiate.

Referring to FIG. 5, another preferred embodiment is suitable for the control of surface waves on conducting regions by use of chiral and nonchiral layers. For example, this control can either reduce or increase the radar cross section of such objects. Thus, chiral coatings provided in accordance with the present invention are useful for altering scattering and surface wave effects from an electromagnetic scatterer. Here a metallic or highly conducting body 400 is covered with a chiral shield 410 comprising one or more chiral or nonchiral layers. Conditions for controlling the surface wave induced by the incident field can be found by through the chiral Helmholtz equation (11) and the appropriate boundary conditions (12)–(13).

Chiroreflectors in which the reflection is enhanced can also be made from the configurations of FIGS. 2–5 using the condition where the right hand side of equation (14) is maximized.

Possible applications for chiral coatings and structures provided in accordance with the present invention include the ability to greatly reduce reflectivity of scatterers over specified frequency regimes, to construct low Radar Cross Section (RCS) structures or to increase RCS for use as radio wave, microwave and millimeter wave decoys, and the RCS reduction of edges, corners and tips. Further applications include, antireflection material for radio wave, microwave and millimeter wave anechoic chambers, radome and antenna construction, materials for photonics, and materials for millimeter wave and microwave electronics components. Additionally, chiral coatings and structures provided in accordance with this invention find uses in, medical heating and hyperthermia, food preparation and heating, industrial heating, construction of structures with small optical, infra-red and millimeter wave signatures and the construction of coatings for enhanced heating by microwaves, millimeters waves and infra-red radiation..

There have thus been described certain preferred embodiments of chiral structures and coatings provided in accordance with this invention. While preferred embodiments have been disclosed, it will be recognized by those with skill in the art that modifications are within the true spirit and scope of the invention. The appended claims are intended to cover all such modifications.

What is claimed is:

1. A coated electromagnetic scatter in an electromagnetic environment comprising:

electromagnetic scattering means for scattering electromagnetic radiation;

at least one chiral layer interfaced with the electromagnetic scattering means for altering scattering and surface wave effects from the electromagnetic scattering means; and at least one nonchiral layer interfaced with the electromagnetic scattering means for altering scattering and surface wave effects from the electromagnetic scattering means, wherein the chiral and nonchiral layers provide impedance matching between the electromagnetic scattering means and the environment whereby when electromagnetic energy incidents the scatterer the chiral layer causes the electromagnetic energy to propagate according to two circularly polarized eigenmodes of propagation in the chiral layer.

2. The coated electromagnetic scatter recited in claim 1 wherein the electromagnetic scattering means comprises a substantially conductive material.

3. The coated electromagnetic scatterer recited in claim 2 wherein the nonchiral layer comprises a dielectric and magnetic material wherein the dielectric and magnetic material are partially lossy.

4. A coated electromagnetic scatter comprising:

a substantially conductive scatter;

a nonchiral layer having a first thickness and a first and second side wherein the first side of the nonchiral layer is attached to the substantially conductive scatter; and a chiral layer having a second thickness attached to the second side of the nonchiral layer, wherein the nonchiral and chiral layers substantially absorb incident electromagnetic radiation to the coated electromagnetic scatter and alter scattering from the substantially conductive scatter whereby when electromagnetic energy incidents the scatterer the chiral layer causes the electromagnetic energy to propagate according to two circularly polarized eigenmodes of propagation in the chiral layer.

5. The coated electromagnetic scatterer recited in claim 4 wherein the nonchiral layer comprises a partially lossy material.

6. The coated electromagnetic scatterer recited in claim 5 wherein the nonchiral layer further comprises a magnetic material.

7. The coated electromagnetic scatterer recited in claim 6 wherein the chiral layer is partially lossy.

8. The coated electromagnetic scatterer recited in claim 7 wherein the second thickness is substantially less than the first thickness.

9. The coated electromagnetic scatterer recited in claim 8 wherein the second thickness is less than about one half the wavelength of the electromagnetic radiation.

10. A method of constructing a coated electromagnetic scatter which alters scattering of electromagnetic radiation and surface wave effects comprising the steps of:

coating an electromagnetic scatterer with a plurality of chiral layers having specified thickness which alter scattering and surface wave effects; and coating the electromagnetic scatter with a plurality of nonchiral layers having specified thickness which alter scattering and surface wave effects, wherein the chiral and nonchiral layers are adapted to provide modification of impedance matching and absorption for incident electromagnetic radiation whereby when electromagnetic energy incidents the scatterer the chiral layers cause the electromagnetic energy to propagate according to two circularly polarized eigenmodes of propagation in the chiral layer.

11. The method recited in claim 10 wherein the nonchiral layers comprise a lossy material.

12. The method recited in claim 11 wherein the nonchiral layers further comprise a magnetic material.

13. The method recited in claim 12 wherein the chiral layers are partially lossy.

* * * * *